US010024138B2

(12) United States Patent
Ringgenberg

(10) Patent No.: US 10,024,138 B2
(45) Date of Patent: Jul. 17, 2018

(54) PRESSURE RESPONSIVE DOWNHOLE TOOL WITH LOW PRESSURE LOCK OPEN FEATURE AND RELATED METHODS

(71) Applicant: Halliburton Energy Services, Inc., Houston, TX (US)

(72) Inventor: Paul David Ringgenberg, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 382 days.

(21) Appl. No.: 14/758,109

(22) PCT Filed: Feb. 20, 2013

(86) PCT No.: PCT/US2013/026881
§ 371 (c)(1),
(2) Date: Jun. 26, 2015

(87) PCT Pub. No.: WO2014/130024
PCT Pub. Date: Aug. 28, 2014

(65) Prior Publication Data
US 2015/0330184 A1 Nov. 19, 2015

(51) Int. Cl.
*E21B 34/10* (2006.01)
*E21B 34/14* (2006.01)
*E21B 34/00* (2006.01)

(52) U.S. Cl.
CPC ..... *E21B 34/102* (2013.01); *E21B 34/14* (2013.01); *E21B 2034/002* (2013.01)

(58) Field of Classification Search
None
See application file for complete search history.

(56) References Cited

U.S. PATENT DOCUMENTS 3,533,430 A * 10/1970 Fredd ..... E21B 34/08 137/112
4,125,165 A * 11/1978 Helmus ..... E21B 34/103 166/264
4,489,786 A 12/1984 Beck
(Continued)

OTHER PUBLICATIONS

International Search Report and the Written Opinion of the International Searching Authority, or the Declaration, dated Oct. 25, 2013, PCT/US2013/026881, 11 pages, ISA/KR.

*Primary Examiner* — Shane Bomar
(74) *Attorney, Agent, or Firm* — Haynes and Boone, LLP

(57) ABSTRACT

A pressure responsive downhole tool includes a bi-directional collet utilized in conjunction with a pressure retaining chamber to control a ball valve utilizing a change in wellbore annulus pressure. Without substantially altering the pressure change between various operative functions, the tool can utilize the rate of pressure increase/decrease to drive the tool to different configurations. Initially, a pressure increase is utilized to engage the operation mechanism of a ball valve. Subsequently, the pressure increase can be utilized to open and close the ball valve. By varying the rate of the pressure increase and/or decrease, the position of the ball valve when the annulus pressure is bled off can be controlled, thereby permitting the ball valve to either closed when annulus pressure is decreased or remain locked-open when the annulus pressure is decreased.

19 Claims, 10 Drawing Sheets

(56) References Cited

U.S. PATENT DOCUMENTS

| | | | | | |
|---|---|---|---|---|---|
| 4,537,258 | A | | 8/1985 | Beck | |
| 4,736,798 | A | * | 4/1988 | Zunkel | E21B 23/006 166/321 |
| 4,979,568 | A | * | 12/1990 | Spencer, III | E21B 23/006 166/321 |
| 5,209,303 | A | * | 5/1993 | Barrington | E21B 34/108 166/321 |
| 5,240,072 | A | | 8/1993 | Schultz et al. | |
| 5,558,162 | A | | 9/1996 | Manke et al. | |
| 5,984,014 | A | | 11/1999 | Poullard et al. | |

* cited by examiner

PRESSURE RESPONSIVE DOWNHOLE TOOL WITH LOW PRESSURE LOCK OPEN FEATURE AND RELATED METHODS

The present application is a U.S. National Stage patent application of International Patent Application No. PCT/US2013/026881, filed on Feb. 20, 2013, the benefit of which is claimed and the disclosure of which is incorporated herein by reference in its entirety.

FIELD OF THE INVENTION

The present invention relates generally to pressure responsive tools and, more specifically, to a pressure responsive downhole tool having an operating valve element that can remain open when annulus pressure is relieved.

BACKGROUND

Conventional tester valves utilize annulus pressure to operate a valve element, such as a ball valve, where application of predetermined annulus pressure can be utilized to open the valve element while reduction of the annulus pressure can be utilized to close the valve element. One drawback to such a system is that the valve element will not remain in an open position when the annulus pressure is reduced. For certain downhole activities, however, it is desirable to hold a tester valve in such a "lock open" configuration once annulus pressure is reduced.

More recent tester valves employ mechanisms to lock open the valve element when annulus pressure is reduced. Specifically, a movable slotted sleeve is utilized to index the position of an actuation arm so that the actuation arm will not force the valve element to a closed position when the annulus pressure is relieved. While such systems may be functionally satisfactory, the systems utilized to apply the motivation force to move the slotted sleeve are complicated and often require operating pressures to activate the lock open feature that are significantly higher than the normal annulus pressure. For example, normal operating annulus pressures utilized with tester valves are typically in the range of 1200 psi, whereas annulus pressures of 2500 psi are required to operate lock-open features of certain prior art tester valves. Persons of ordinary skill in the art will appreciate that use of such high pressures with systems as described can adversely impact other components of the downhole mechanism, such as rupture disks, or system components with lower pressure ratings.

Accordingly, in view of the foregoing, there is a need in the art for a tester valve that utilizes lower annulus pressures to locked open a valve element. Such a tester valve would desirably utilize the same approximate annulus pressure to both operate the valve element and to lock open the valve element as desired.

DESCRIPTION OF ILLUSTRATIVE EMBODIMENTS

Figure 1A:
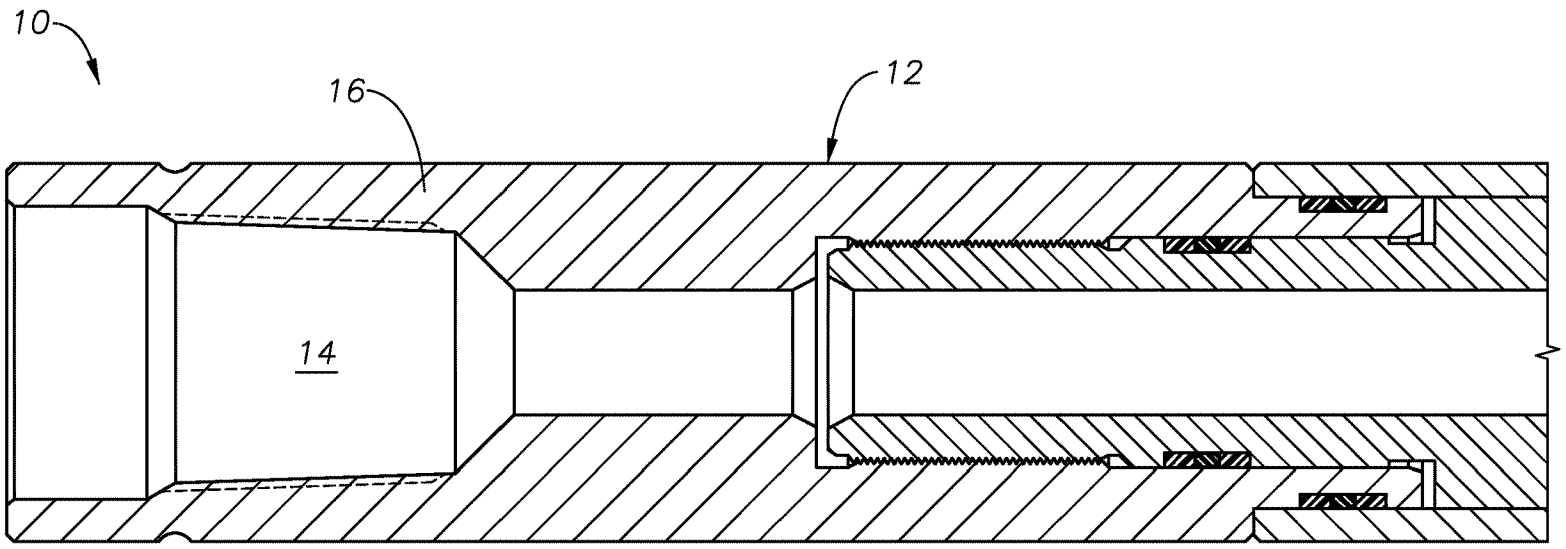
FIGS. 1A-1I are sectional views of an annular pressure responsive downhole tool having a lock open feature operable by the same approximate annulus pressures utilized to open and close a valve.

Illustrative embodiments and related methodologies of the present invention are described below as they might be employed in a pressure responsive downhole tool having a lock open feature for a valve element that employs the same approximate annulus pressure utilized to open and close the valve element. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

As described herein, exemplary embodiments of the present invention are directed to a pressure responsive downhole tool having a power piston pressure relief valve that may be selectively deactivated and activated to allow operations to be conducted using the tool. The pressure responsive downhole tool may be a variety of tools, such as, for example, a tester valve as described in U.S. Pat. No. 5,558,162, entitled "MECHANICAL LOCKOUT FOR PRESSURE RESPONSIVE DOWNHOLE TOOL," also owned by the Assignee of the present invention, Halliburton Energy Services, Co. of Houston, Tex., the disclosure of which is hereby incorporated by reference in its entirety. As such, the inventive features described herein will be discussed in relation to a drill stem tester ("DST") valve. However, those ordinarily skilled in the art having the benefit of this disclosure realize the present invention may be applied to any variety of pressure responsive tools.

As further described herein, exemplary embodiments of the pressure responsive tool includes a bidirectional collet system utilized in conjunction with pressurized fluids to operate a ball valve system as described herein. In embodiments utilized within a drill stem tester valve, during downhole deployment of the tool, the ball valve system is in the open position. Once the tool has been positioned within a wellbore, the annulus pressure within the wellbore is raised. As the annulus pressure increases, the annulus pressure actuates an upper piston that is secured to an operating mandrel system and a bidirectional collet system. Movement of the upper piston under application of annular pressure causes the bi-directional collet system to engage a first shoulder defined on an internal static mandrel to temporarily inhibit continued movement of the piston. Once the applied annular pressure has reached a predetermined threshold, the bi-directional collet system disengages the first shoulder and translates across the shoulder, allowing the piston to continue to actuate. At this point, a lower portion of the operating mandrel system shifts relative to locking dogs carried by an upper portion of the operating mandrel system until the locking dogs radially engage the lower portion of the operating mandrel system, thereby securing the upper and lower portions of the operating mandrel system to one another. In conjunction with actuation of the piston, a fluid within a fluid chamber is pressurized to the annulus pressure. As the annulus pressure is thereafter slowly bled down, the pressurized fluid is maintained at an elevated pressure relative to the annulus pressure such that the pressurized fluid bearing on the upper piston urges the bi-directional collet system into engagement with a second shoulder defined on the internal static mandrel to temporarily inhibit movement of the piston. Once the pressure differential across the upper piston between the reduced annulus pressure and the pressurized fluid reaches a predetermined threshold, the bi-directional collet system disengages the second shoulder and translates back across the shoulder, allowing the piston to continue to actuate. This actuation causes the operating mandrel system attached to the piston to drive the ball valve system from an open to a closed position. An adjustable metering mechanism maintains the elevated pressure of the pressurized fluid even as the annulus fluid is bled down.

To the extent it is desired to have the ball valve system remain open once the annulus pressure is bled down, then the annulus pressure is increased sufficiently to drive the collet across the first shoulder. Thereafter, the annulus pressure is bled down quickly. In such case, the collet lands on the second shoulder as described above. However, due to the expedited pressure annulus pressure change, the fluid within the fluid chamber cannot be sufficiently pressurized to overcome the force needed to drive the collet back across the second shoulder as described above. In other words, the necessary pressure differential cannot be achieved. As such, the collet remains seated on the second shoulder and the ball valve system remains open even though the annulus pressure has been bled down.

Referring now to FIGS. 1A-1I, an annular pressure responsive tool 10 will now be described in accordance to one or more exemplary embodiments of the present invention. As previously described, annular pressure responsive tool 10 may be, for example, a drill stem tester valve. For example, annular pressure responsive tool 10 may be used with a formation testing string during the testing of an oil well to determine production capabilities of a subsurface formation. The testing string can be lowered into a wellbore such that a well annulus is defined between the test string and the wellbore. A packer system or other sealing system (not shown) positioned in the wellbore downhole of tool 10 may be actuated to seal the well annulus so that the well annulus can be pressurized, as herein described, to operate tool 10.

Referring now to FIGS. 1A-1I of the present invention, the annular pressure responsive tool 10 includes a housing 12 having a central flow passage 14 disposed longitudinally therethrough. Housing 12 includes an upper adapter 16, a valve housing section 18, a connector section 24, a ported nipple section 20, an upper gas chamber section 26, a gas nipple section 28, a lower gas chamber section 30, a metering mechanism section 32, a lower oil chamber section 34 and a lower adapter 36. The components just listed are connected together preferably in the order listed from top to bottom with various conventional threaded and sealed connections.

The valve housing section 18 generally includes an upper seat holder mandrel 54 threadingly connected to upper adapter 16. Upper seat holder mandrel 54 includes shoulder 62 against which an upper valve seat assembly 68 is received. An operating element, such as a spherical ball valve 70, is carried by valve housing 18. In particular, spherical ball valve 70 is bounded by upper valve seat assembly 68 as well as a lower valve seat assembly 74 which is carried a lower seat holder mandrel 76. A biasing member 82, such as a Belleville spring, for example, is located below lower seat 74 to provide the necessary resilient clamping of the ball valve 70 between seat assemblies 68 and 74. Ball valve 70 has a bore 72 disposed therethrough. In FIG. 1, ball valve 70 is shown in its open position so that the bore 72 of ball valve 70 is aligned with the longitudinal flow passage 14, or through bore, of annular pressure responsive tool 10. As will be further described below, when ball valve 70 is rotated to its closed position, the bore 72 is isolated from the central flow passage 14 of annular pressure responsive tool 10.

Disposed below valve housing section 18 is connector section 24. Connector section 24 generally includes an operating mandrel assembly 92 having an upper operating mandrel portion 94 disposed to slide axially within housing 12 and a lower operating mandrel portion 98 disposed to slide axially relative to upper operating mandrel portion 94 as described below. Upper operating mandrel portion 94 engages an actuating arm 86, which actuating arm 86 includes an actuating lug 88 disposed thereon. Actuating lug 88 engages an eccentric bore 90 defined in ball valve 70 so that the ball valve 70 may be rotated between an open position (shown in FIG. 1*b*) and a closed position as upper operating mandrel portion 94, and actuating arm 86 connected thereto, slides relative to housing 12. Although not shown, in certain preferred embodiments, there are two such actuating arms 86 with lugs 88 engaging two such eccentric bores 90. Further details regarding the operation of ball valve 70 will be understood by those ordinarily skilled in the art having the benefit of this disclosure.

Upper operating mandrel portion 94 carries at least one and preferably a plurality of locking dogs 112, each of which is disposed adjacent a radial window 114 in upper operating mandrel portion 94 and biased radially inward by a biasing element 116, such as annular springs 116, to urge the locking dog 112 against lower operating mandrel portion 98. Lower operating mandrel portion 98 is closely slidably received within a bore 119 of upper operating mandrel portion 94.

Lower operating mandrel portion 98 carries an annular radial outer groove 118. Lower operating mandrel portion 98 is disposed to slide freely relative to upper operating mandrel portion 94 until locking dogs 112 are received within annular groove 118, thereby securing lower operating mandrel portion 98 to upper operating mandrel portion 94. Once locked together, actuation of lower operating mandrel portion 98 will result in actuation of upper operating mandrel portion 94, which in turn actuates actuating arm 86 so as to cause rotation of ball 70. As will be appreciated, therefore, actuation of lower operating mandrel portion 98 can be utilized to open and close ball valve 70.

Figure 1B:
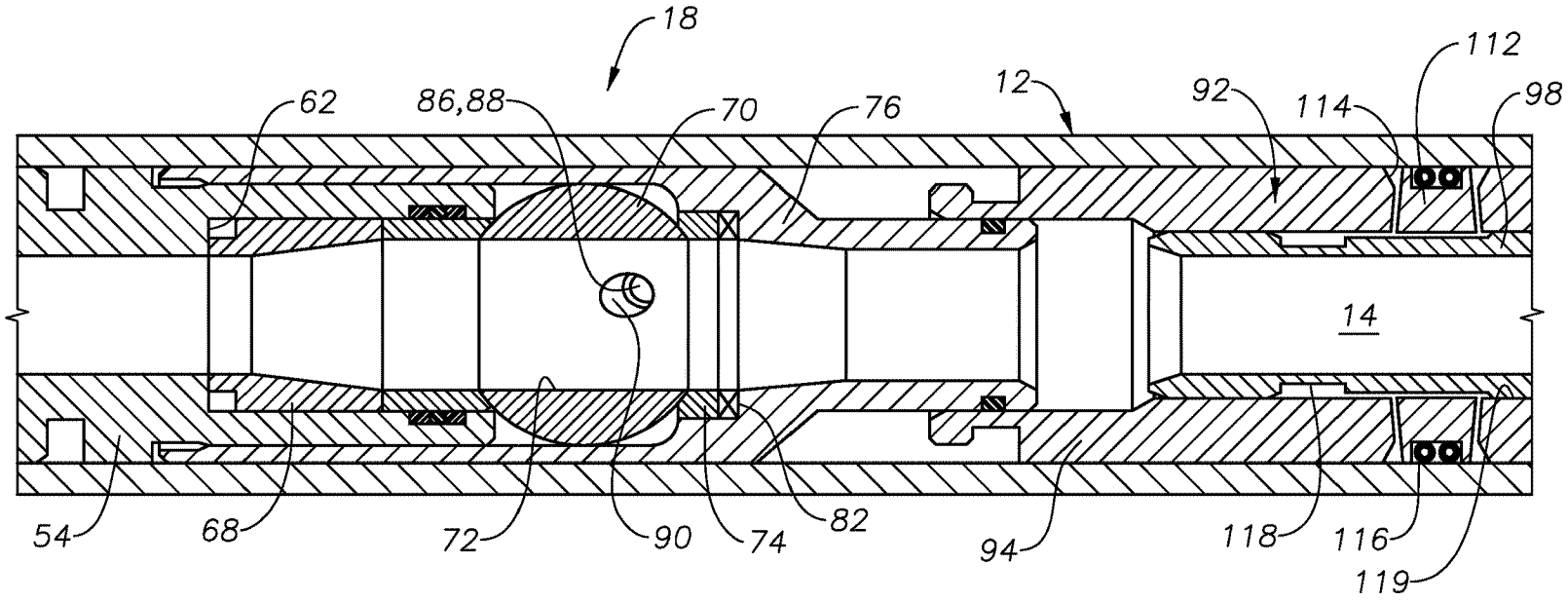

Ball valve assembly section 18 and operating mandrel assembly 92 are seen in FIG. 1*b*, where annular pressure responsive tool 10 is shown in an initial run-in configuration in which the ball valve 70 is in an open position. However, as will also be described herein, annular pressure responsive tool 10 may also be initially run into the well with the ball valve 70 in a closed position.

Figure 1C:
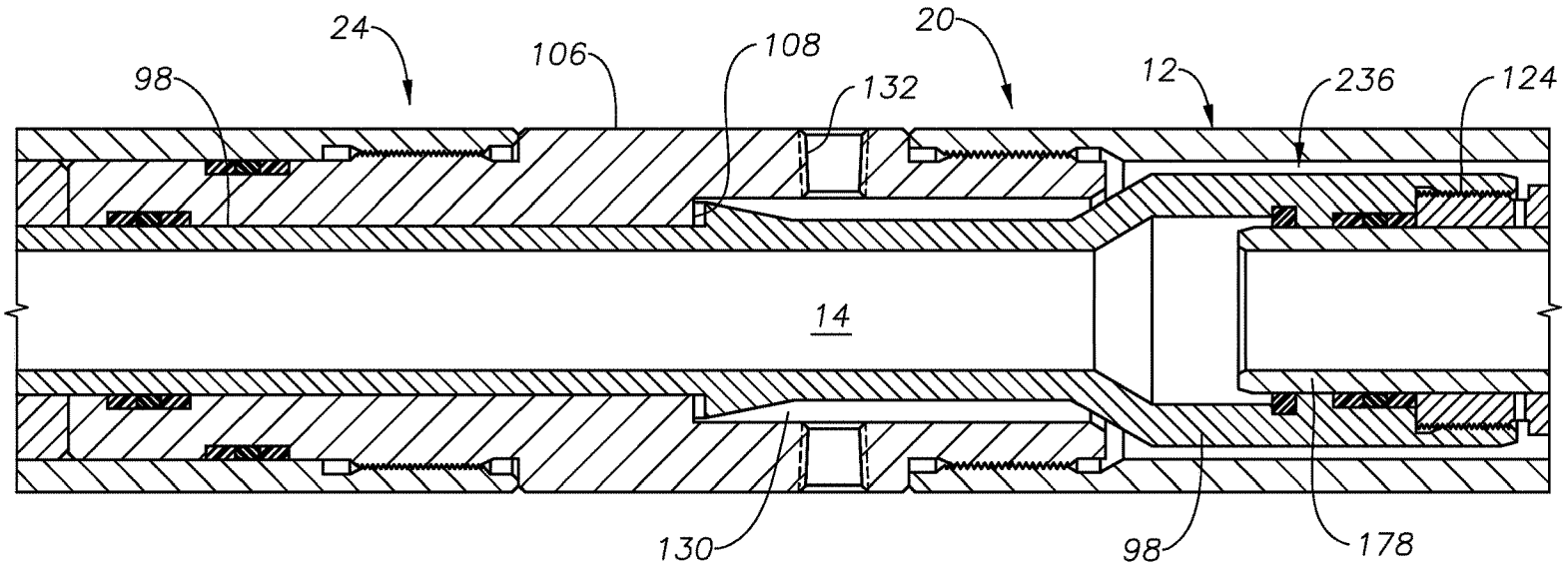

Disposed below connector section 24 is ported nipple section 20, as best seen in FIG. 1*c*. Ported nipple section 20 generally includes an adapter 106. Lower operating mandrel portion 98 extends through adapter 106 so as to define an annular mud chamber 130 by the annulus therebetween. One or more ports 132 are radially disposed through adapter 106 to permit fluid communication between the well annulus surrounding annular pressure responsive tool 10 and the mud chamber 130. Also shown in FIG. 1*c* is a shoulder 108 defined within housing 12 to limit axial movement of lower operating mandrel portion 98. Although shoulder 108 is show as formed by adapter 106, persons of ordinary skill in the art will appreciate that shoulder 108 could be formed anywhere within tool 10 along the operating length of lower operating mandrel portion 98. In any event, adapter 106 generally joins the portion of housing 12 that defines connector section 24 with the portion of the housing 12 that defines upper gas chamber section 26.

Figure 2:
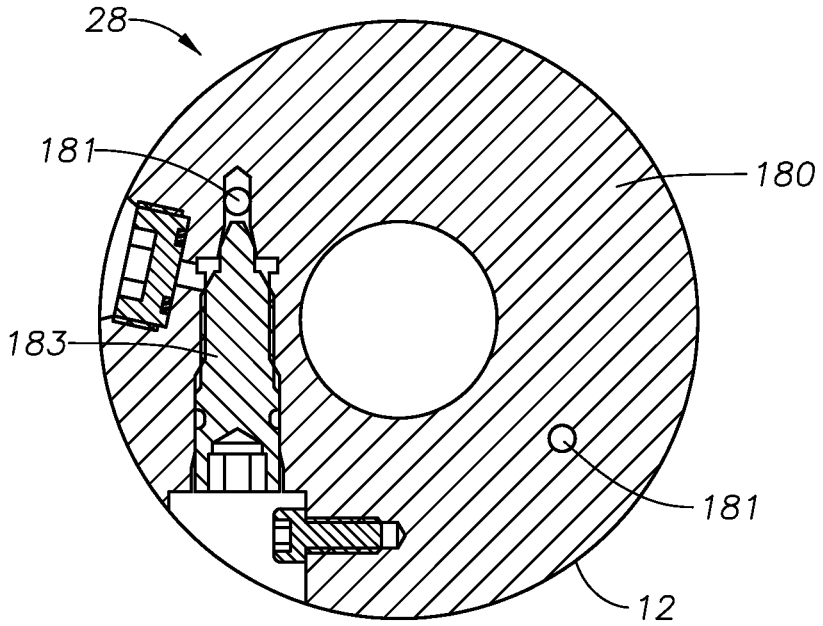
FIG. 2 illustrates a cross-sectional view B-B of the downhole tool of FIG. 1 taken through the gas port mandrel.
Figure 3:
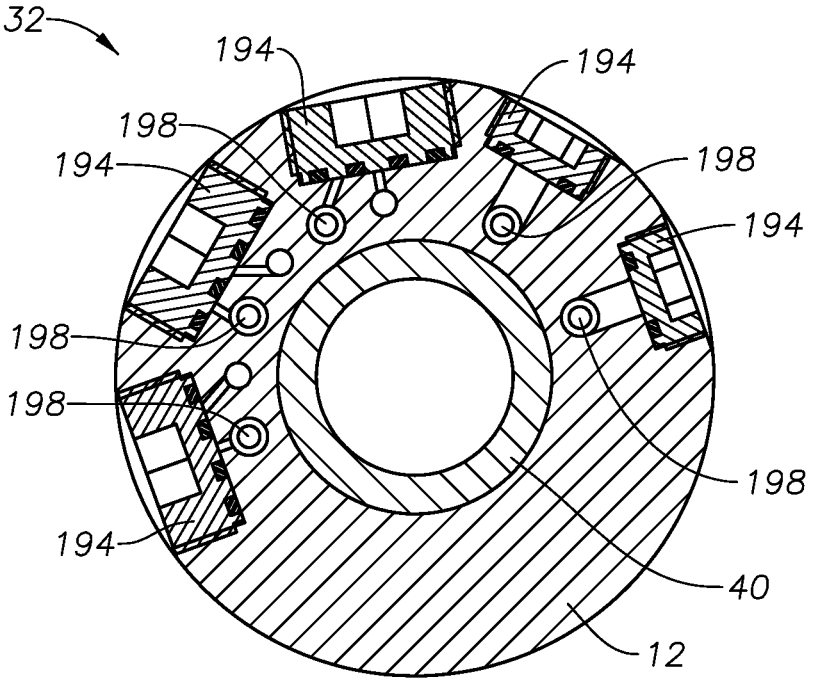
FIG. 3 illustrates a cross-sectional view E-E of the downhole tool of FIG. 1 taken through the metering mechanism section.

In this regard, disposed below ported nipple section 20 is upper gas chamber section 26, which includes upper gas chamber 176. Upper gas chamber section 26, in turn, is adjacent gas nipple section 28, which separates upper gas chamber section 26 from a lower gas chamber section 30, which includes a lower gas chamber 182. Gas nipple section 28 includes a gas port mandrel 180 having a gas nipple 186 in fluid communication with the upper and lower gas chambers 176, 182 by way of one or more flow passages defined within gas port mandrel 180 which also function to fluidly communicate upper chamber 176 with lower chamber 182. Although chambers 176 and 182 can be filled with any fluid, in certain preferred embodiments, chambers 176 and 182 are filled with nitrogen gas that can be pressurized as desired. A gas filler valve 183 (shown in FIG. 2) is disposed in gas nipple 186 to control the flow of gas into the nitrogen chambers and to seal the same in place therein. The nitrogen chambers 176 and 182 serve as accumulators which store increases in annulus pressure that enter annular pressure responsive tool 10 through power ports 132 above and through equalizing port 214. The nitrogen accumulators also function to balance the pressure increases against each other and, upon subsequent reduction of annulus pressure, to release the stored pressure to cause a reverse pressure differential within annulus pressure responsive tool 10.

Figure 1D:
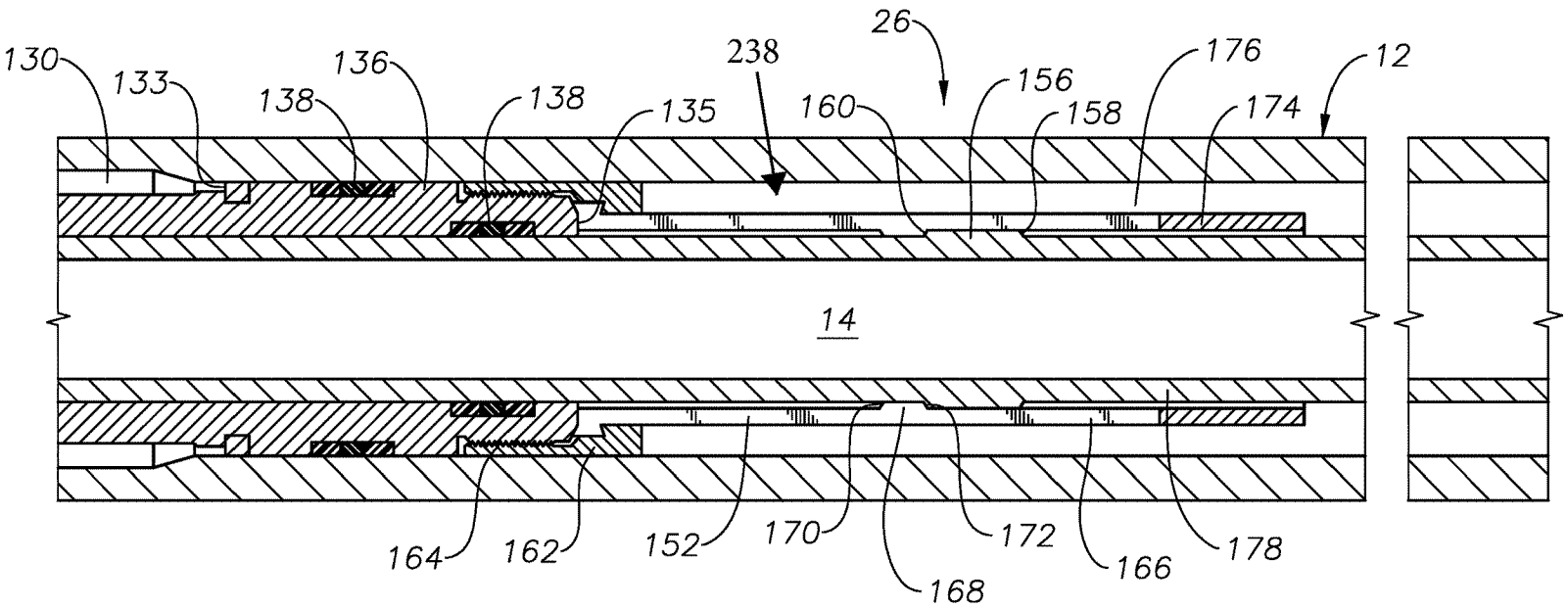

As best shown in FIG. 1*d*, with ongoing reference to FIG. 1*c*, an actuating piston 136 is slidably received within upper gas chamber 176 and includes seals 138. Actuating piston 136 includes an upper side 133 and lower side 135.

Actuating piston 136 serves to isolate well fluid, e.g., mud, entering port 132 and disposed within mud chamber 130 from the fluid, e.g., gas, contained in upper gas chamber 176. Actuating piston 136 is connected at threads 124 to lower operating mandrel portion 98. Hence, actuation of piston 136 by virtue of a pressure differential across piston 136 between the mud in mud chamber 130 and the gas in upper gas chamber 176 results in actuation of operating mandrel assembly 92 and ball valve 70.

Actuating piston 136 is slidingly disposed around an elongated static mandrel 178 that generally extends within bore 14 from approximate ported nipple section 20, through upper gas chamber section 26 and is secured adjacent gas nipple section 28 by gas port mandrel 180. Static mandrel 178 carries a radially outward extending flange 156 having a lower tapered shoulder 158 and an upper tapered shoulder 160 defined thereon.

Referring now to FIG. 1*d*, actuating piston 136 also is attached to a bidirectional collet assembly 152 that generally extends into upper gas chamber 176 from the lower side 135 of actuating piston 136. Collet assembly 152 generally includes a collet retaining mechanism 162 fixedly attached to actuating piston 136 at thread 164. A plurality of spring collet fingers 166 extend axially from retaining mechanism 162. Each finger 166 carries a collet engagement mechanism 168, such as a head, which defines upper and lower tapered retaining shoulders 170 and 172, respectively. Collet assembly 152 may further include a sleeve 174 about the distal end of fingers 166.

In a first position, which may include the initial run-in position, as seen in FIG. 1*d*, collet engagement mechanism 168 is located above flange 156. As mud pressure within mud chamber 130 increases, actuating piston 136 will slide along static mandrel 178 until the lower tapered retaining shoulder 172 of collet head 168 engaging the upper tapered shoulder 160 of the flange 156 of static mandrel 178. This engagement temporarily prevents actuating piston 136 (and hence, lower operating mandrel portion 98) from moving downward relative to static mandrel 178 until a sufficient downward force is applied at surface 133 to actuating piston 136 in order to cause the collet fingers 166 to be cammed radially outward and pass up over flange 156, thus allowing operating mandrel assembly 92 to move downward relative to housing 12. Similarly, subsequent engagement of lower tapered shoulder 160 of flange 156 with lower tapered shoulder 172 of collet head 168 will temporarily prevent the operating mandrel assembly 92 from moving back to its upward most position relative to housing 12 until a sufficient pressure differential is applied across actuating piston 136. In certain embodiments of the present invention, a differential pressure in the range of from 500 to 700 psi, for example, is required to move the actuating piston 136 from a first position in which the lower shoulder 172 of engagement mechanism 168 engages flange 156 to a second position in which the upper shoulder 170 of engagement mechanism 168 engages flange 156. Thus, bi-directional collet assembly 152 permits pressure to be manipulated as described below, in order to actuate tool 10 for a particular configuration. Moreover, collet is preferably disposed to slide within a sealed gas chamber, thereby minimizing the likelihood of contaminants or particulate matter interfering with operation of the collet as will be described herein.

Figure 1E:
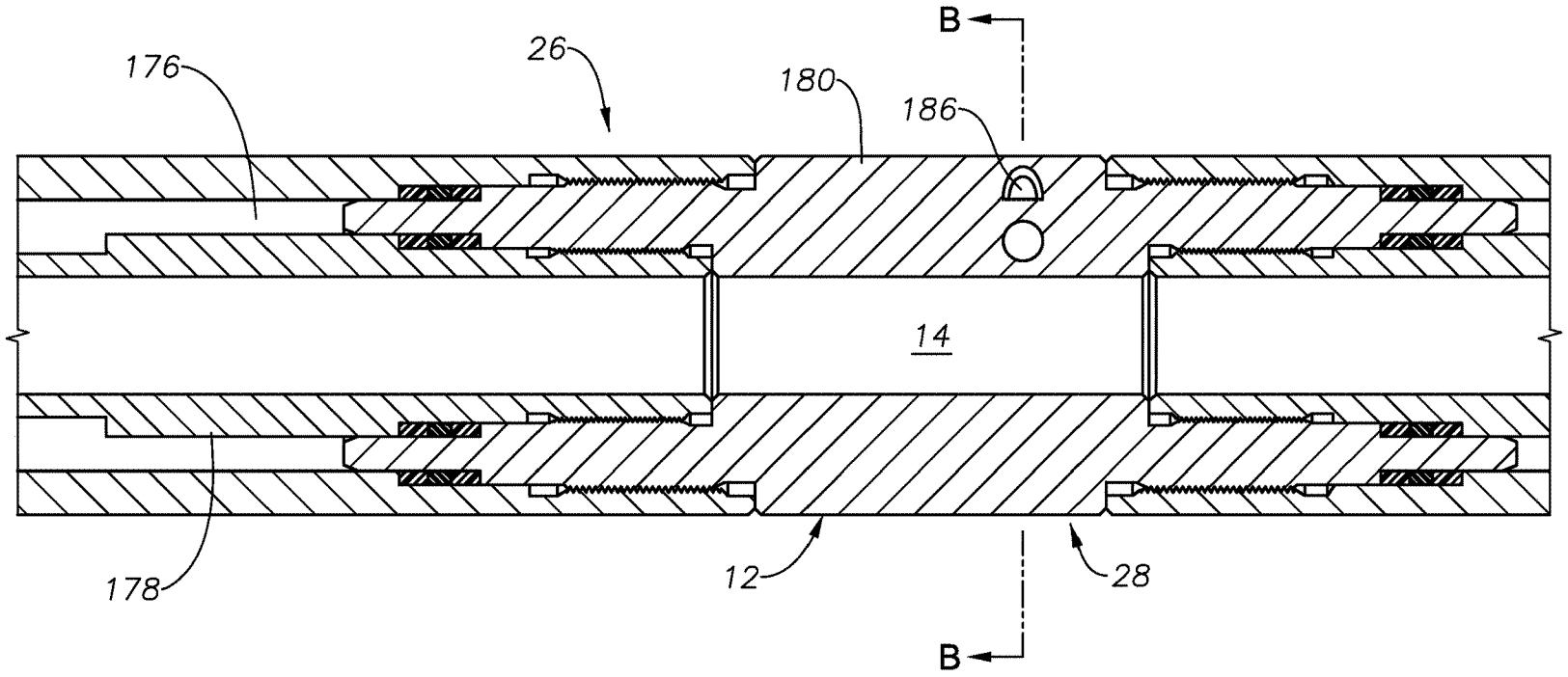
Figure 1F:
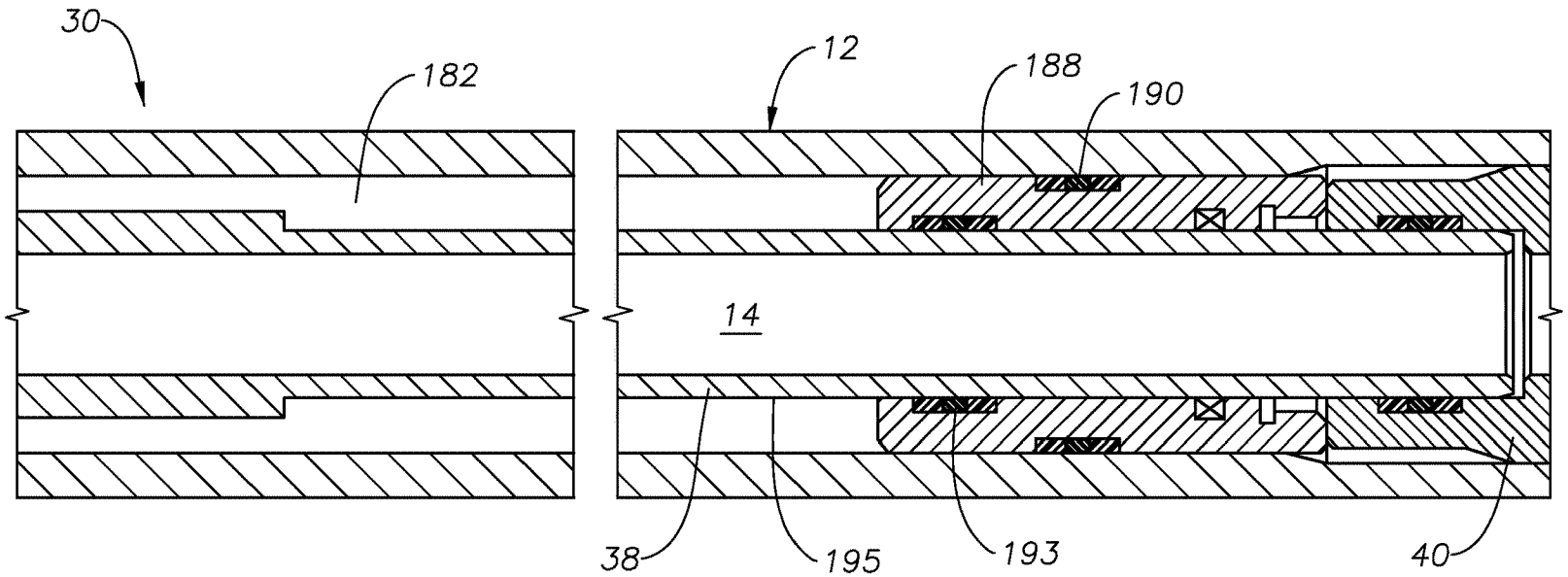

Referring to FIGS. 1*e* and 1*f*, lower gas chamber section 30 is illustrated. In one preferred embodiment, lower gas chamber 182 is defined by the annulus between housing 12 and an upper inner tubular member 38. A floating piston or isolation piston 188 is slidingly disposed in lower gas chamber 182. It carries an outer annular seal 190 which seals against an inner bore 192 of housing 12 of lower gas chamber section 30. Piston 188 carries an annular inner seal 193 which seals against an outer cylindrical surface 195 of upper inner tubular member 38. Lower isolation piston 188 isolates gas in the lower gas chamber 182 from a hydraulic fluid, such as oil, contained in the lower most portion of chamber 182 below the piston 188.

Figure 1G:
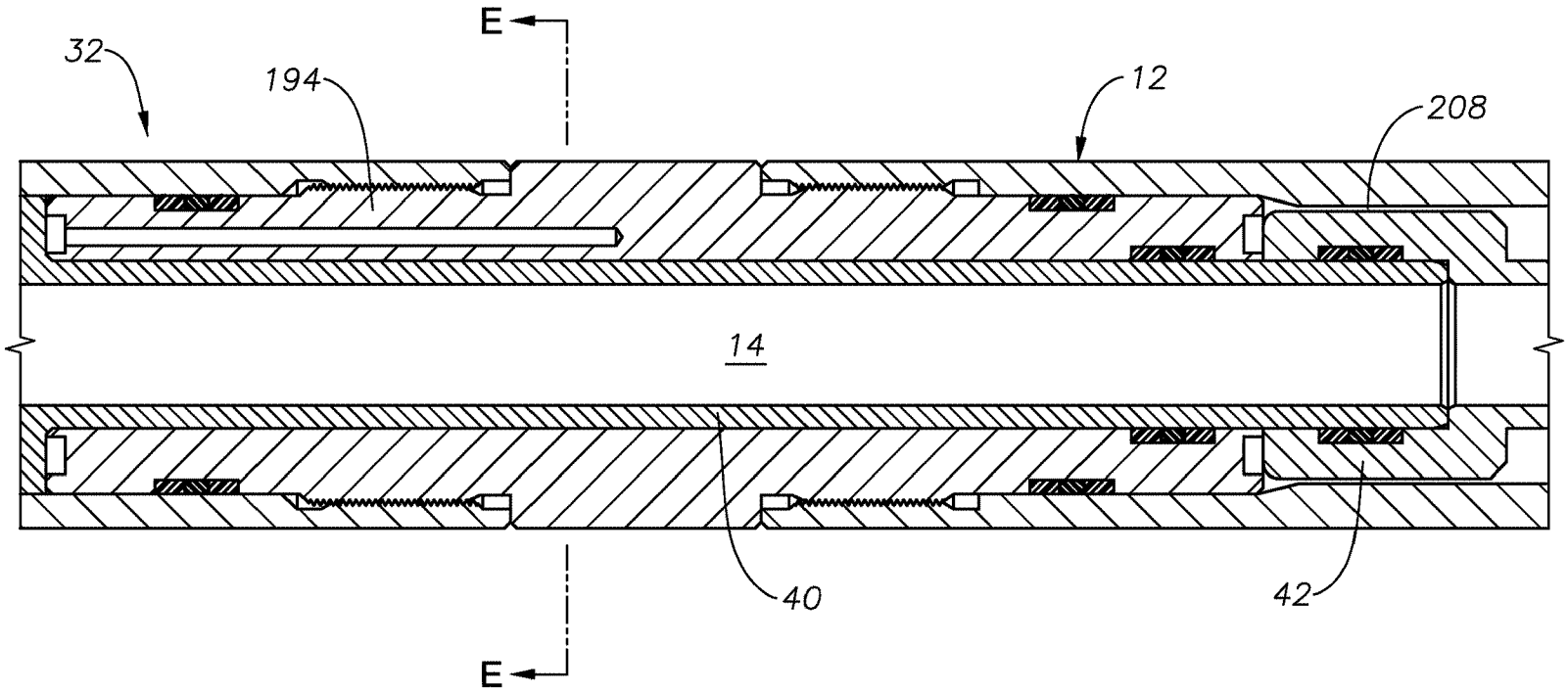

Disposed below lower gas chamber section 30 is fluid metering mechanism section 32, as best seen in FIG. 1*g*. Fluid metering mechanism section 32 includes an intermediate inner tubular member 40 extending axially through metering mechanism section 32 and an annular multi-range metering mechanism 194 disposed between intermediate inner tubular member 40 and housing 12. Multi-range metering mechanism 194 provides a retarding function and is adjustable to meter fluid over a wide range of differential pressures. Metering mechanism 194 carries outer annular seal 196 which seals against the inner bore of housing 12. An upper end of multi-range metering mechanism 194 is communicated with the lower gas chamber 182 by a plurality of flow passageways 198 formed in the radially outer portion of section 32. Operation of multi-range metering mechanism 194 will not be described herein, as those ordinarily skilled in the art having the benefit of this disclosure will readily understand its function and operation.

Figure 1H:
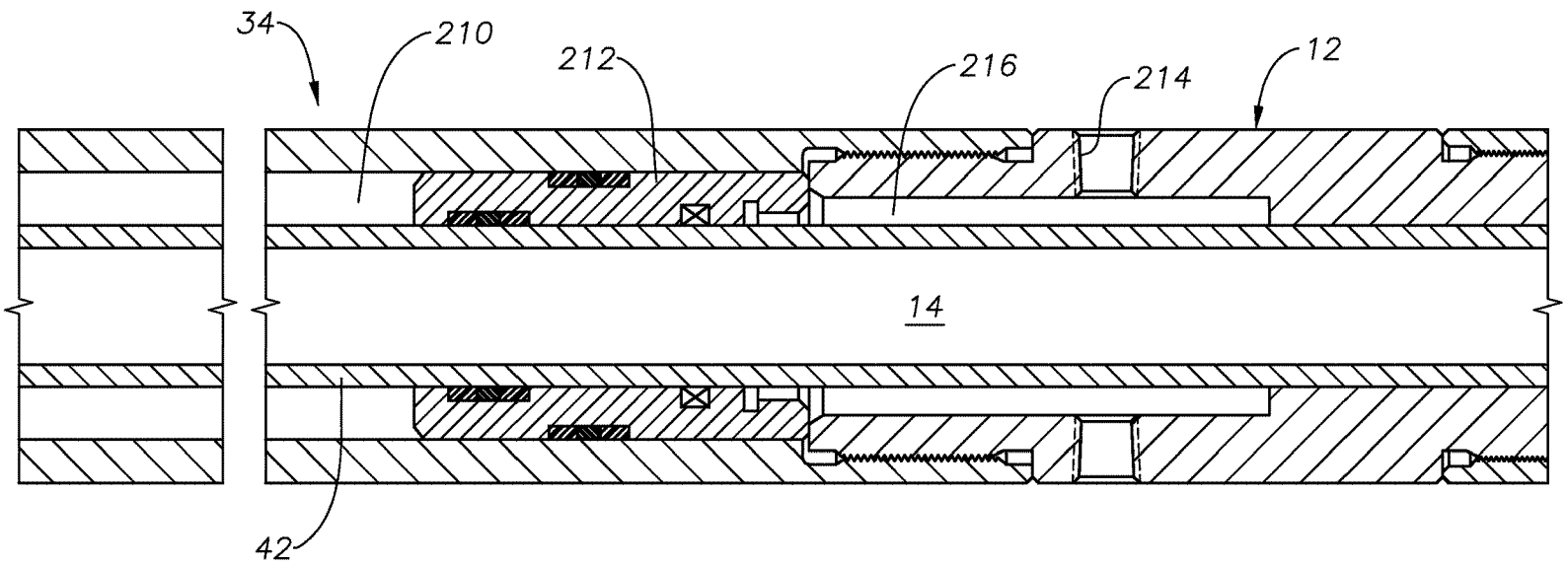
Figure 1I:
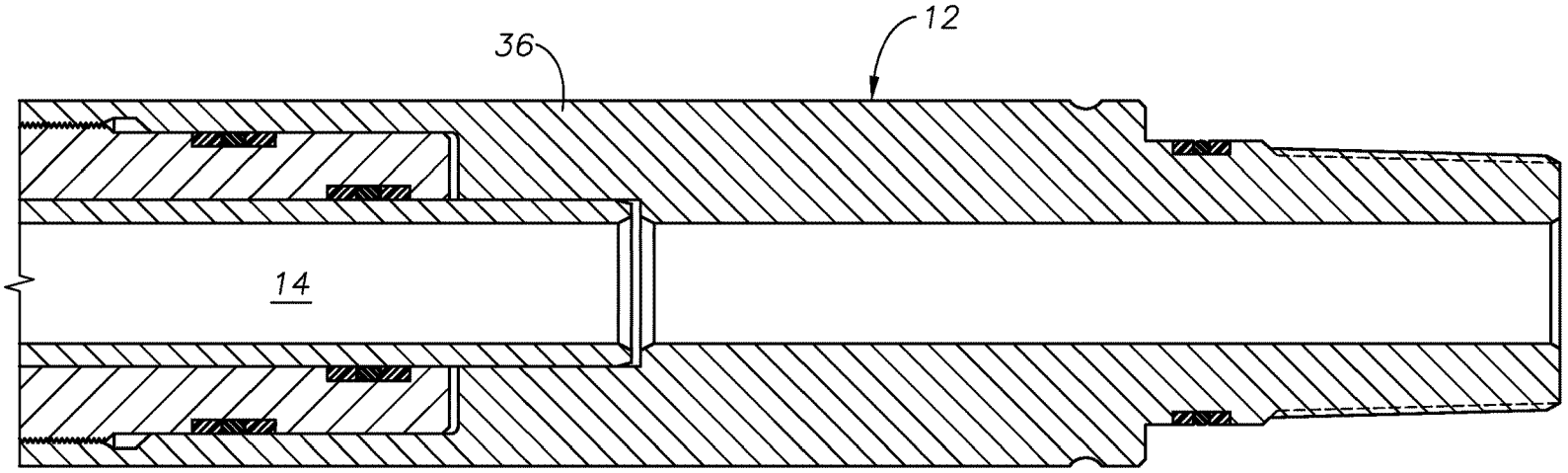

Referring now to FIGS. 1*g* and 1*h*, multi-range metering mechanism 194 communicates, via annular passages 208 with an oil filled equalizing chamber 210 defined within oil chamber section 34. In one preferred embodiment, oil filled equalizing chamber 210 is defined by the annulus between a lower inner tubular member 42 and housing 12. Oil chamber section 34 further includes a floating piston or isolation piston 212 is slidably disposed in equalizing chamber 210 about lower inner tubular member 42 and isolates oil thereabove from well fluids such as mud which enters therebelow into a lower mud chamber 216 through an equalizing port 214 defined through the wall of housing 12.

Referring to FIGS. 1A-1I, housing 12 can be generally described as having a first pressure conducting passage system 236 defined therein for communicating the well annulus with the upper side 133 of piston 136. In certain exemplary embodiments, the first pressure conducting passage system 236 includes, for example, power port 132 and annular mud chamber 130. Housing 12 can also be generally described as having a second pressure conducting passage system 238 defined therein for communicating the well annulus with the lower side 135 of actuating piston 136. The second pressure conducting passage system 238 includes upper gas chamber 176, flow passages 181 through gas port mandrel 180, lower nitrogen chamber 182, the flow path of multi-range metering mechanism 194, annular passage 208, equalizing chamber 210 and equalizing port 214.

As understood in the art, multi-range metering mechanism 194 and the various passages and components contained therein can generally be described as a retarding mechanism disposed in the second pressure conducting passage system 238 for delaying communication of a sufficient portion of a change in well annulus pressure to the lower side 135 of piston 136 for a sufficient amount of time to allow a pressure differential on the lower side 135 of actuating piston 136 to move the actuating piston 136 upwardly relative to housing 12. Retarding mechanism also functions to maintain a sufficient portion of a change in well annulus pressure within the second pressure conducting passage and permit the differential in pressures between the first and second pressure conducting passages to balance.

Moreover, ball valve 70 can generally be referred to as an operating element operably associated with actuating piston 136 for movement with piston 136 between a first closed position and a second open position. However, in other exemplary embodiments, the first position may be open, while the second position may be closed. Those ordinarily skilled in the art having the benefit of this disclosure will realize that this and a variety of other alterations may be embodied within annular pressure responsive tool 10 without departing from the spirit and scope of the present invention.

Now that the various exemplary components of annular pressure responsive tool 10 have been described, an exemplary operation conducted using annular pressure responsive tool 10 will now be described with reference to FIGS. 1A-1I. As will be understood by those ordinarily skilled in the art having the benefit of this disclosure, ball valve 70 may be opened and closed by increasing and decreasing the annulus pressure between hydrostatic pressure and a first level above hydrostatic. In an initial run-in configuration, (i) ball valve 70 is preferably in an open position; (ii) locking dogs 112 are unseated from groove 118; and (iii) collet head 168 is positioned above or uphole from flange 156, preferably spaced apart from flange 156. Additionally, fluid pressure within the gas chambers 176, 182, as well as the oil chamber 210 are at hydrostatic pressure. In an alternative embodiment, ball valve 70 may be run-in in a closed position.

To describe an exemplary operation in more detail, annular pressure responsive tool 10 is made up, deployed downhole and positioned at a desired location. After annular pressure responsive tool 10 has been positioned at the desired location, a pressure increase is imposed upon the well annulus so that the annulus pressure of the mud around housing 12 is raised to a first desired pressure above hydrostatic. As will be appreciated, the rate at which the annulus pressure is increased and decreased (or bled off) can be utilized to drive tool 10 to either a first configuration in which ball valve 70 remains open when pressure is decreased or a second configuration in which ball valve 70 closes with pressure decrease. If annulus pressure is more slowly increased, gas chambers 176, 182 will retain or store the increased annulus pressure, which can subsequently be utilized to drive ball valve 70 to a close position. Conversely, if the annulus pressure is more rapidly increased and rapidly decreased, there is not sufficient time to transfer and store the pressure increase in gas chambers 176, 182, and as such, the result will be ball valve 70 remaining open upon the decrease in annulus pressure. Thus, a first rate of increase may be used for one function and a second rate of increase, different from the first, may be used for a different function.

With respect to storage of annulus pressure in gas chambers 176, 182, annulus pressure is transmitted into mud chamber 130 through port 132 and along the first pressure conducting passage 236 to exert annulus fluid pressure upon actuating piston 136 to move actuating piston 136 downward, compressing the gas within upper gas chamber 176. As the actuating piston 136 compresses the gas within upper gas chamber 176, the annulus fluid pressure is transmitted to the gas within gas chamber 176. Likewise, being in fluid communication with lower gas chamber 182, the pressure of the gas in upper chamber 176 is transmitted to the gas in lower gas chamber 182. As such, the pressure increase within the first pressure conducting passage 236, following downward movement of the piston 136, is stored with the nitrogen chambers 176 and 182 via compression of nitrogen gas contained within. An offsetting amount of fluid pressure is likewise transmitted upward along the second pressure conducting passage 238 through port 214 at the same time that it is transmitted downward along the first pressure conducting passage 236 through port 132. A slow increase in pressure permits the increased annulus pressure to be transmitted to and stored in chambers 176, 182 by virtue of both the first and second pressure conducting passages 236, 238. In such case, annulus pressure at port 214 is transmitted through oil chamber 210 to lower gas chamber 182. In contrast, a more rapid increase in pressure does not permit sufficient time for the annulus pressure to be transmitted along the second pressure conducting passage 238. Thus, while piston 136 may be driven to compress the gas in upper chamber 176 via upper pressure conducing passage 236 with a more rapid increase in annulus pressure, because there is not a corresponding application of annulus pressure from second conducting passage 238, the increased annulus pressure will not be retained by the gas chambers.

Notwithstanding the foregoing, in a first position, which may include the initial run-in position, as seen in FIG. **1*d*, collet head 168 is located above flange 156, preferably spaced apart or offset from flange 156. Thus, in addition to pressuring gas within chambers 176 and 182, movement of the upper piston 136 under application of annular pressure causes the collet head 168 of collet finger 166 to shift relative to static mandrel 178 until the upper retaining shoulder 170 of a collet head 168 of collet finger 166 engages first shoulder 160 defined on an static mandrel 178, temporarily inhibiting continued movement of piston 136. Once the applied annular pressure has reached a predetermined threshold sufficient to overcome the friction force between the collet shoulder 172 and the flange 156, the collet finger 166 disengages the first flange shoulder 160 and translates across flange 156, allowing the piston 136 to continue to actuate. At this point, the lower operating mandrel portion 98 shifts relative to locking dogs 112 carried by the upper operating mandrel portion 92 until the locking dogs 112 radially engage the lower portion 98 by seating in grooves 118, thereby securing the upper and lower operating mandrel portions 92, 98 to one another. It should be noted that the foregoing engagement occurs regardless of the rate of increase of the annulus pressure so long as the pressure increase is sufficient to drive head 168 across flange 156**.

As annulus pressure is decreased or bled down once locking dogs 112 are engaged, if there is not sufficient pressure stored in gas chamber 176, collet finger 166 will shift relative to static mandrel 178 until shoulder 170 of collet head 168 engages second flange shoulder 158 of flange 156. Without sufficient application of pressure from chamber 176 to overcome the friction force between shoulder 170 of collet head 168 and second flange shoulder 158, collet finger 166 will not disengage the second shoulder 158 and translate across flange 156. Rather, additional upward travel of piston 136 will be stopped. Since lower operating mandrel portion 98 is fixed to piston 136 and upper operating mandrel portion 94 is secured to lower operating mandrel portion 98 by virtue of locking dogs 112, the actuating arm 86 attached to upper operating mandrel portion 94 and used to close ball valve 70 is not actuated. As such, ball valve 70 remains open with further bleed down of annulus pressure, thereby.

In contrast, if gas chamber 176 has sufficient pressure stored therein, collet finger 166 will disengage the second shoulder 158 and collet head 168 will translate across flange 156. Thereafter, pressure applied to piston 136 from gas chamber 176 will continue to urge piston 136 to shift upward relative to static mandrel 178. By virtue of the operating mandrel assembly 72 which is attached to both piston 136 and actuating arm 86, actuating arm 86 will be driven upward, thereby causing ball valve 70 to close.

The retarding function of the multi-range metering mechanism 194 is used to delay the increase in well annulus pressure from being communicated from oil chamber 210. As a result of the delay, the pressure within the first pressure conducting passage 236 will be greater than that within the second pressure conducting passage 238 during the delay. Eventually, the pressure differential between the first and second pressure conducting passages 236, 238 will become relatively balanced after a period of time.

When it is desired to close ball valve 70, annulus pressure may be reduced to hydrostatic causing a reverse pressure differential within both the first and second pressure conducting passages 236 and 238 from the stored pressure within the nitrogen chambers 176 and 182. Metering mechanism 194 delays transmittal of the pressure differential downward within the second pressure conducting passage 238, thereby maintaining an increased level of pressure within the upper portions of the second pressure conducting passage 238. The pressure differential upward within first pressure conducting passage 236 urges collet head 168 upwardly across flange 156. As piston 136 moves upwardly, the upward motion is transmitted to actuating arm 86, and ball valve 70 is moved to its closed position.

Thus, it will be appreciated that a rapid increase in annulus pressure will not result in sufficient pressure build up and storage in gas chamber 176 to overcome the "lock-open" force applied by collet fingers 166 to flange 156 because the multi-range metering mechanism 194 delays transmission of pressure necessary to allow pressure build up and storage in gas chamber 176. As such, ball valve 70 will remain open. It is only when annulus pressure is permitted to be transferred and stored in gas chamber 176, through a less rapid increase in annulus pressure over a more extended period of time, that the retained pressure in gas chamber 176 is sufficient to dislodge collet head 168 from flange 156, permitting continued movement of piston 136 so as to drive ball valve 70 to a closed position. In other words, increasing and/or decreasing the annulus pressure at a first rate will result in configuration of the tool to one state, while increasing and/or decreasing the annulus pressure at a second rate, different from the first rate will result in configuration of the tool to a different state, even as the pressure changes are substantially within the same range.

Accordingly, through use of the present invention, ball valve 70 can be locked open utilizing only the normal increase in annulus pressure otherwise utilized to simply open and close ball valve 70, thereby eliminating the need for elevated annulus pressures required for lock open features of the prior art. In certain preferred embodiments, the normal annulus operating pressure is in a range below the pressure at which rupture disks or other pressure devices may be activated. In certain preferred embodiments, the normal annulus operating pressure is around 1200 psi. Likewise, while particular first and second rates for annulus pressure application and/or release depend on the operating environment of the tool, in one embodiment, a first rate may be 20 psi/second while a second rate may be 2 psi/second.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A pressure responsive downhole tool, comprising:

a tool housing;

a collet finger within the tool housing;

a flange within the tool housing and disposed to engage the collet finger;

an actuating piston slidably disposed within the tool housing, the actuating piston having a first pressure surface and a second pressure surface, the actuating piston movable between a first position in which the relative positions of the collet and flange are in a first configuration and a second position in which the relative positions of the collet and flange are in a second configuration;

a first pressure conducting passage for communicating a well annulus pressure to one surface of the piston to move the piston from one position to the other position;

a second pressure conducting passage for communicating a well annulus pressure to the other surface of the piston to move the piston from one position to the other position;

an operating element operably associated with the tool for selective movement with the actuating piston between the first and second positions;

a lower operating mandrel slidably disposed to move upon movement of the actuating piston between the first and second positions;

an upper operating mandrel slidably disposed within the housing to drive the operating element from a first configuration to a second configuration; and a locking mechanism disposed to lock lower and upper operating mandrels together when the collet and flange are driven from one configuration to the other configuration.

2. A tool as defined in claim 1, wherein the operating element is a ball valve assembly that allows fluid communication through a bore of the tool when the ball valve is in a first position and prevents fluid communication through the bore when the ball valve is in a second position.

3. A tool as defined in claim 2, further comprising a mechanism to selectively actuate the ball valve assembly to the second position in response to changes in the well annulus pressure.

4. A pressure responsive downhole tool, comprising:

a tool housing;

a collet finger within the tool housing;

a flange within the tool housing and disposed to engage the collet finger;

an actuating piston slidably disposed within the tool housing, the actuating piston having a first pressure surface and a second pressure surface, the actuating piston movable between a first position in which the relative positions of the collet and flange are in a first configuration and a second position in which the relative positions of the collet and flange are in a second configuration;

a first pressure conducting passage for communicating a well annulus pressure to one surface of the piston to move the piston from one position to the other position;

a second pressure conducting passage for communicating a well annulus pressure to the other surface of the piston to move the piston from one position to the other position;

an operating element operably associated with the tool for selective movement with the actuating piston between the first and second positions;

wherein the first pressure conducting passage comprises a first pressure port in the tool housing and disposed to communicate pressure from an exterior surface of the tool housing to a first interior mud pressure chamber formed within the tool housing, which first mud chamber is in fluid communication with the first surface of the actuating piston; and wherein the second pressure conducting passage comprises:

a second pressure port in the tool housing and disposed to communicate pressure from an exterior surface of the tool housing to a second interior mud pressure chamber formed within the tool housing, and a first fluid pressure chamber defined within the housing and in pressure communication with the second surface of the actuating piston.

5. A tool as defined in claim 1, wherein the piston is slidable around a fixed mandrel disposed within the tool housing, the collet finger is engaged by the piston and the flange is formed on the fixed mandrel.

6. A tool as defined in claim 4, wherein the second pressure conducting passage further comprises a second fluid pressure chamber defined within the housing with a second piston disposed therein, a third fluid chamber defined within the housing with a third piston disposed therein, wherein the first and second fluid chambers have gas disposed therein and the third fluid chamber has oil disposed therein.

7. A pressure responsive downhole tool, comprising:

a tool housing having an exterior surface and an interior;

an actuating piston slidably disposed within the tool housing, the actuating piston having a first pressure surface and a second pressure surface, the actuating piston movable between at least a first position and a second position, wherein the first pressure surface is in fluid communication with the exterior surface of the tool housing;

a flange fixed within the tool housing, the flange having a first shoulder and a second shoulder;

a bi-directional collet within the tool housing, the bi-directional collet having a plurality of collet fingers, each finger having a collet head disposed thereon, wherein the bi-directional collet is attached to the actuating piston and disposed to move axially within the housing, wherein the head of each collet finger engages the first shoulder of the flange when the piston is in the first position and the head of each collet finger engages the second shoulder of the flange when the piston is in the second position;

a first gas chamber in fluid communication with the second pressure surface of the actuating piston; and a valve element within the tool housing and selectively movable between a closed position and an open position upon movement of the actuating piston.

8. A tool as defined in claim 7, further comprising a fluid metering mechanism disposed to selectively control the flow of fluid within the gas chamber.

9. A tool as defined in claim 7, wherein the actuating piston is slidable to a third position in which the head of each collet finger is spaced apart from the second shoulder of the flange, the tool further comprising a lower operating mandrel engaged by the piston and slidably disposed to move upon movement of the actuating piston;

an upper operating mandrel slidably disposed within the housing and movable between at least a first position where the valve element is in the open position and a second position where the valve element is in the closed position; and a locking mechanism disposed to lock lower and upper operating mandrels together when the actuating piston is in the third position.

10. A tool as defined in claim 7, further comprising a second gas chamber defined within the housing with a second piston disposed therein, a first oil chamber defined within the housing with a third piston disposed therein, wherein the first and second gas chambers have gas disposed therein and the oil chamber has oil disposed therein, wherein the first and second gas chambers are in fluid communication with one another.

11. A tool as defined in claim 8, further comprising a pressure port defined in the tool housing between the exterior surface of the tool and the interior, the pressure port in pressure communication with the first gas chamber via the metering mechanism.

12. A tool as defined in claim 7, wherein the piston is slidable around a fixed mandrel disposed within the tool housing, the flange is formed on the fixed mandrel and the collet fingers extend into a gas chamber and slide axially relative to the fixed mandrel.

13. A method of using a pressure responsive downhole tool, the method comprising:

deploying the tool to a desired location within a well;

raising well annulus pressure to a first pressure to move an actuation piston from a first position to a second position, thereby resulting in relative movement between a bi-directional collet engagement mechanism and a flange disposed to engage the collet;

once the collet and flange have moved relative to one another by virtue of the piston movement, locking an actuation arm linked to an operating element to movement of the piston;

once the actuation arm has been locked to movement of the piston, driving the piston under a first pressure rate to cause an operating element of the tool to move from a first configuration to a second configuration in response to a change in the well annulus pressure; and driving the piston under a second pressure rate to hold an operating element of the tool in the first configuration when subjected to substantially the same change in the well annulus pressure.

14. A method as defined in claim 13, further comprising storing the annulus pressure in a pressure chamber when the piston is driven at the first rate.

15. A method as defined in claim 14, wherein the storing comprises utilizing the actuation piston to compress gas within the pressure chamber when the piston moves from the first position to the second position.

16. A method as defined in claim 15, further comprising retaining the first pressure in the pressure chamber as the well annulus pressure is decreased to a second pressure lower than the first pressure.

17. A method as defined in claim 13, further comprising continuing to apply well annulus pressure once the actuation piston has moved to the second position, so as to drive the actuation piston to a third position in which the collet engagement mechanism is spaced apart from the flange and locking the actuation arm to movement of the piston at the third position.

18. A method as defined in claim 13, wherein driving the piston under a first pressure rate causes a ball valve within the tool to close as the well annulus pressure is decreased from the first pressure; and driving the piston under a second pressure rate causes the ball valve to remain open as the well annulus pressure is decreased from the first pressure.

19. A method as defined in claim 18, wherein the first pressure rate is greater than the second pressure rate.

* * * * *